US007113180B2

(12) United States Patent
Nakano et al.

(10) Patent No.: US 7,113,180 B2
(45) Date of Patent: Sep. 26, 2006

(54) PLURALITY OF COLUMN ELECTRODE DRIVING CIRCUITS AND DISPLAY DEVICE INCLUDING THE SAME

(75) Inventors: Taketoshi Nakano, Ise (JP); Takafumi Kawaguchi, Taki-gun (JP); Toshihiro Yanagi, Nara (JP); Keishi Nishikubo, Taki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 566 days.

(21) Appl. No.: 09/911,780

(22) Filed: Jul. 24, 2001

(65) Prior Publication Data

US 2002/0075204 A1 Jun. 20, 2002

(30) Foreign Application Priority Data

Jul. 24, 2000 (JP) ..... 2000-223171
Apr. 11, 2001 (JP) ..... 2001-113320

(51) Int. Cl.
*G09G 5/00* (2006.01)

(52) U.S. Cl. ..... 345/204; 345/99; 345/100

(58) Field of Classification Search ..... 345/204, 345/205, 206, 87, 88, 89, 90, 98, 99, 100
See application file for complete search history.

(56) References Cited

U.S. PATENT DOCUMENTS 5,572,211 A * 11/1996 Erhart et al. ..... 341/144
6,025,822 A * 2/2000 Motegi et al. ..... 345/98

(Continued)

FOREIGN PATENT DOCUMENTS

JP 6-274134 9/1994

(Continued)

OTHER PUBLICATIONS

Copy of Korean Office Action dated Sep. 30, 2003 (no translation).

(Continued)

*Primary Examiner*—Richard Hjerpe
*Assistant Examiner*—Jean Lesperance
(74) *Attorney, Agent, or Firm*—David G. Conlin; John J. Penny, Jr.; Edwards Angell Palmer & Dodge LLP

(57) ABSTRACT

A plurality of column electrode driving circuits is used in a matrix type display device including a plurality of row electrode driving circuits each for driving a plurality of row electrodes and the plurality of column electrode driving circuits each for driving a plurality of column electrodes. Each of the plurality of column electrode driving circuits includes a data input section for receiving a control data signal for the plurality of column electrodes; a timing control section for generating a timing control signal for controlling at least one of the row electrode driving circuit and the column electrode driving circuit; a selection section for selecting one of a signal in synchronization with the timing signal generated by the timing control section and the control data signal input to the data input section, based on the control data signal input to the data input section; and a data output section for outputting one of the signal in synchronization with the timing signal and the control data signal which is selected by the selection section. The data input section of a second column electrode driving circuit of the plurality of column electrode driving circuits is connected to the data output section of a first column electrode driving circuit of the plurality of column electrode driving circuits, and the data output section of the second column electrode driving circuit is connected to the data input section of a third column electrode driving circuit of the plurality of column electrode driving circuits.

8 Claims, 6 Drawing Sheets

U.S. PATENT DOCUMENTS

| | | | | |
|---|---|---|---|---|
| 6,211,849 | B1 * | 4/2001 | Sasaki et al. | 345/55 |
| 6,333,214 | B1 | 12/2001 | Kim et al. | 438/142 |

FOREIGN PATENT DOCUMENTS

| | | |
|---|---|---|
| JP | 10-62746 | 3/1998 |
| JP | 10-153760 | 6/1998 |
| JP | 11-015451 | 1/1999 |
| JP | 11-194713 | 7/1999 |
| JP | 11-194748 | 7/1999 |
| KR | 1998-025131 | 7/1998 |

OTHER PUBLICATIONS

* Copy of Japanese Office Action dated May 17, 2004.

* cited by examiner

PLURALITY OF COLUMN ELECTRODE DRIVING CIRCUITS AND DISPLAY DEVICE INCLUDING THE SAME

BACKGROUND OF THE INVENTION

1. Field of the Invention

The present invention relates to a plurality of column electrode driving circuits used in a display device such as, for example, a liquid crystal display device, and a display device including the plurality of column electrode driving circuits.

2. Description of the Related Art

A liquid crystal display device includes a pair of glass substrates and a liquid crystal layer interposed between the pair of glass substrates. FIG. 5 is a plan view illustrating a schematic structure of one of the glass substrates of a conventional liquid crystal display device. The one of the glass substrates will be referred to as a "control glass substrate". The control glass substrate is indicated with reference numeral 21. The control glass substrate 21 includes a display section 21*a*. The liquid crystal layer is interposed in a plane corresponding to the display section 21*a*. The control glass substrate 21 has a plurality of row electrodes (gate electrodes) 205 and a plurality of column electrodes (source electrodes) 206 thereon. The plurality of row electrodes 205 are parallel to each other, and the plurality of column electrodes 206 are parallel to each other. The plurality of row electrodes 205 and the plurality of column electrodes 206 are perpendicular to each other. The other glass substrate (not shown; hereinafter, referred to as a counter glass substrate) has a common electrode provided on substantially the entirety of a surface thereof, the surface being closer to the liquid crystal layer than the other surface of the counter glass substrate.

The control glass substrate 21 has a lengthy gate substrate 29 thereon along one side thereof. The control glass substrate 21 has a lengthy source substrate 25 along a side thereof, which is perpendicular to the side along which the gate substrate 29 is provided. There is a gap between the display section 21*a* and the gate substrate 29. There is a gap between the display section 21*a* and the source substrate 25. A plurality of row electrode driving circuits (gate driver ICs) 22, each for driving a plurality of row electrodes 205, are provided to straddle the gap between the gate substrate 29 and the display section 21*a*. A plurality of column electrode driving circuits (source driver ICs) 23, each for driving a plurality of column electrodes 206, are provided to straddle the gap between the source substrate 25 and the display section 21*a*.

A control substrate 31 is provided in the vicinity of the gate substrate 29 and the source substrate 25. A timing controller IC 34 is mounted on the control substrate 31.

FIG. 6 is a block diagram illustrating an internal structure of the timing controller IC 34. The timing controller IC 34 includes an input buffer 34*a* for receiving a control data signal (for example, a display data signal regarding each of RGB colors in a color image displayed by the display section 21*a*, a clock signal CK, a horizontal synchronous signal HS, a vertical synchronous signal VS, an enable signal ENAB, or the like).

The timing controller IC 34 further includes a timing control section 34*b* for outputting a column electrode driving timing signal and a row electrode driving timing signal based on the control data signal which is input to the input buffer 34*a*, a source-side output buffer 34*c* for outputting a display data signal in synchronization with the column electrode driving timing signal which is output from the timing control section 34*b*, and a gate-side output buffer 34*d* for outputting the row electrode driving timing signal which is output from the timing control section 34*b*.

The timing control section 34*b* generates a column electrode driving timing signal such as, for example, a source start pulse (SSP) or a source clock (SCK) for each column electrode driving circuit 23 based on the control data signal which is output from the input buffer 34*a*. The timing control section 34*b* outputs each column electrode driving timing signal generated by the timing control section 34*b* to the source-side output buffer 34*c*. Then, the source-side output buffer 34*a* outputs the received column electrode driving timing signal to a respective column electrode driving circuit 23 on the source substrate 25 via a line 25*a* provided on a flexible printed circuit board (FPC) 33 (FIG. 5) and on the source substrate 25.

Similarly, the timing control section 34*b* also generates a row electrode driving timing signal (or a scanning signal) such as, for example, a gate start pulse (GSP) or a gate clock (GCK) for each row electrode driving circuit 22 based on the control data signal which is output from the input buffer 34*a*. The timing control section 34*b* outputs each row electrode driving timing signal generated by the timing control section 34*b* to the gate-side output buffer 34*d*. Then, the gate-side output buffer 34*d* outputs the received row electrode driving timing signal to a respective row electrode driving circuit 22 on the gate substrate 29 via a line 29*a* provided on an FPC 32 (FIG. 5) and on the gate substrate 29.

As described above, the timing controller IC 34 generates a column electrode driving timing signal for driving each column electrode driving circuit 23 and a row electrode driving timing signal for driving each row electrode driving circuit 22, and outputs a display data signal to each column electrode driving circuit 23 based on the control data signal and the column electrode driving timing signal in synchronization with the column electrode driving timing signal.

In the liquid crystal display device having the above-described structure, each row electrode driving circuit 22 and each column electrode driving circuit 23 are driven based on the respective row electrode driving timing signal and the respective column electrode driving timing signal which are generated by the timing controller IC 34 provided on the control substrate 31. Therefore, the timing controller IC 34 needs to have a sufficiently large size and the control substrate 31 also needs to have a large size for mounting the timing controller IC 34 thereon.

Recently, display devices including liquid crystal display devices have increased in size and become of higher definition. This has required the bus lines on the control substrate 31 and the source substrate 25 to be longer, which increases a load capacitance of each bus line and also increases the number of the column electrode driving circuits 23 connected to each bus line. As a result, the fan-out required of the output buffers 34*c* and 34*d* in the timing controller IC 34 needs to be increased, and stricter timing setting is also required.

In order to output the column electrode driving timing signals and the row electrode driving timing signals from the timing controller IC 34 to the respective column electrode driving circuit 22 and the respective row electrode driving circuit 23, the FPC 32 for connecting the control substrate 31 and the gate substrate 29 and the FPC 33 for connecting the control substrate 31 and the source substrate 25 are required. The line 29*a* provided on the gate substrate 29 and the line 25*a* provided on the source substrate 25 are also required.

These requirements have significant influences on the external appearance of the display devices including an increase in the thickness.

Since the control substrate 31 and the gate substrate 29 are connected to each other using the FPC 32 and the control substrate 31 and the source substrate 25 are connected to each other using the FPC 33, the structure of the display device is complicated and the assembly process becomes more difficult. As a result, the production cost of the display device is raised.

Japanese Laid-Open Publication No. 11-194713 discloses a display device having the following structure. A column electrode driving circuit (source driver) is provided with a timing generation circuit, and the column electrode driving circuit and a row electrode driving circuit (gate driver) are operated based on the column electrode driving timing signal and the row electrode driving timing signal which are generated by the timing generation circuit. Such a structure is simpler and prevents enlargement of the entire size of the device.

Accordingly, in the above-described display device including a plurality of column electrode driving circuits (source drivers) and a plurality of row electrode driving circuits (gate drivers), it can be considered that one of the plurality of column electrode driving circuits is provided with a timing generation circuit, so that a column electrode driving timing signal and a row electrode driving timing signal generated by the timing generation circuit is supplied to each of the plurality of column electrode driving circuits and each of the plurality of row electrode driving circuits.

FIG. 7 is a plan view of a control glass substrate 210. The control substrate 210 includes a plurality of column electrode driving circuits (source drivers). One column electrode driving circuit 23A, among the plurality of column electrode driving circuits 23, includes a timing controller IC 34. Such a structure is not practical for the following reason. The column electrode driving circuit 23A including the timing controller IC 34 needs to have a large output buffer in order to output a column electrode driving timing signal and a row electrode driving timing signal to the other column electrode driving circuits 23 and the other row electrode driving circuits 22, respectively.

In the display device disclosed in Japanese Laid-Open Publication No. 11-194713, the column electrode driving circuits and the row electrode driving circuits are mounted by COG (chip on glass). In such a case, the column electrode driving circuits and the row electrode driving circuits cannot be easily positionally aligned with lines provided on the glass substrate. Therefore, such a display device is not easily produced. In the Japanese Laid-Open Publication No. 11-194713, lines are provided in the display section in order to avoid interference between the lines. This structure undesirably requires an area of the glass substrate around the display section to be enlarged.

SUMMARY OF THE INVENTION

According to one aspect of the invention, a plurality of column electrode driving circuits is used in a matrix type display device including a plurality of row electrode driving circuits each for driving a plurality of row electrodes and the plurality of column electrode driving circuits each for driving a plurality of column electrodes. Each of the plurality of column electrode driving circuits includes a data input section for receiving a control data signal for the plurality of column electrodes; a timing control section for generating a timing control signal for controlling at least one of the row electrode driving circuit and the column electrode driving circuit; a selection section for selecting one of a signal in synchronization with the timing signal generated by the timing control section and the control data signal input to the data input section, based on the control data signal input to the data input section; and a data output section for outputting one of the signal in synchronization with the timing signal and the control data signal which is selected by the selection section. The data input section of a second column electrode driving circuit of the plurality of column electrode driving circuits is connected to the data output section of a first column electrode driving circuit of the plurality of column electrode driving circuits, and the data output section of the second column electrode driving circuit is connected to the data input section of a third column electrode driving circuit of the plurality of column electrode driving circuits.

In one embodiment of the invention, the data input section of the second column electrode driving circuit includes an external data input port for receiving an external control data signal and a transferred data input port for receiving a control data signal from the first column electrode driving circuit, the external data input port and the transferred data input port being switchable. The timing control section of the second column electrode driving circuit is switchable to an operation state or a non-operation state in accordance with the switching between the external data input port and the transferred data input port.

In one embodiment of the invention, the data input section of the second column electrode driving circuit receives one of the external data signal and the control data signal from the first column electrode driving circuit which is selectively input thereto. The timing control section of the second column electrode driving circuit is switchable to an operation state or a non-operation state by the external control data signal.

According to another aspect of the invention, a display device includes a display panel; the above-described plurality of column electrode driving circuits provided on the display panel; and a plurality of row electrode driving circuits provided on the display panel. The plurality of column electrode driving circuits are connected in series along a first side of the display panel, so that a scanning signal from the first column electrode driving circuit, among the plurality of column electrode driving circuits, which is closest to the plurality of row electrode driving circuits, is transferred in a cascading manner in the plurality of column electrode driving circuits. The plurality of row electrode driving circuits are connected in series along a second side of the display panel adjacent to the first side, so that the scanning signal from the first column electrode driving circuit is transferred in a cascading manner in the plurality of row electrode driving circuits. An external control data signal is input to the data input section of the first column electrode driving circuit and is output in synchronization with a timing signal generated by the timing control section of the first column electrode driving circuit. The external control data signal which is output from the first column electrode driving circuit is transferred sequentially in the rest of the plurality of column electrode driving circuits in a cascading manner. The timing signal is transferred sequentially in the plurality of row electrode driving circuits in a cascading manner as the scanning signal.

According to still another aspect of the invention a matrix type display device includes a display panel; a plurality of column electrode driving circuits arranged in a line and provided along a first side of the display panel; and a plurality of row electrode driving circuits arranged in a line and provided along a second side of the display panel, the second side being adjacent to the first side. A control data signal for driving the display panel is input to a first column electrode driving circuit, among the plurality of column electrode driving circuits, which is closest to the plurality of row electrode driving circuits. A timing signal for controlling an operation timing of the plurality of column electrode driving circuits and the plurality of row electrode driving circuits is generated in the first column electrode driving circuit, and the generated timing signal and a data signal are output to a second column electrode driving circuit, among the plurality of column electrode driving circuits, which is directly connected to the first column electrode driving circuit. The output data signal is transferred to a third column electrode driving circuit, among the plurality of column electrode driving circuits, which is directly connected to the second column electrode driving circuit. The generated timing signal is transferred in a cascading manner to the plurality of row electrode driving circuits as a scanning signal.

According to still another aspect of the invention, a matrix type display device includes a display panel; a plurality of column electrode driving circuits arranged in a line on a printed circuit board provided along a first side of the display panel; and a plurality of row electrode driving circuits arranged in a line and provided along a second side of the display panel, the second side being adjacent to the first side. Each of the plurality of column electrode driving circuits is mounted in a tape carrier package. A first column electrode driving circuit, among the plurality of column electrode driving circuits, which is closest to the plurality of row electrode driving circuits, generates a timing signal for controlling an operation timing of the plurality of column electrode driving circuits and the plurality of row electrode driving circuits, and outputs the generated timing signal to a first row electrode driving circuit, among the plurality of row electrode driving circuits, which is closest to the first column electrode driving circuit as a scanning signal. A timing signal which is output from the first column electrode driving circuit is supplied to the first row electrode driving circuit sequentially through a first line portion provided on the tape carrier package mounting the first column electrode driving circuit, a second line portion provided on the printed circuit board, a third line portion provided on the tape carrier package mounting the first column electrode driving circuit, and a fourth line portion provided on the display panel.

According to still another aspect of the invention, a matrix type display device includes a display panel; a plurality of column electrode driving circuits arranged in a line on a printed circuit board provided along a first side of the display panel; and a plurality of row electrode driving circuits arranged in a line and provided along a second side of the display panel, the second side being adjacent to the first side. A timing signal for controlling the plurality of row electrode driving circuits is supplied to one of the plurality of row electrode driving circuits sequentially through a second line portion provided on the printed circuit board, a third line portion provided on one of the plurality of column electrode driving circuits, and a fourth line portion provided on the display panel.

Thus, the invention described herein makes possible the advantages of providing a plurality of column electrode driving circuits usable in a display device for decreasing the size of the display device and allowing the display device to be produced more easily, and a compact and easy-to-produce display device despite including a plurality of column electrode driving circuits and a plurality of row electrode driving circuits.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

Figure 1:
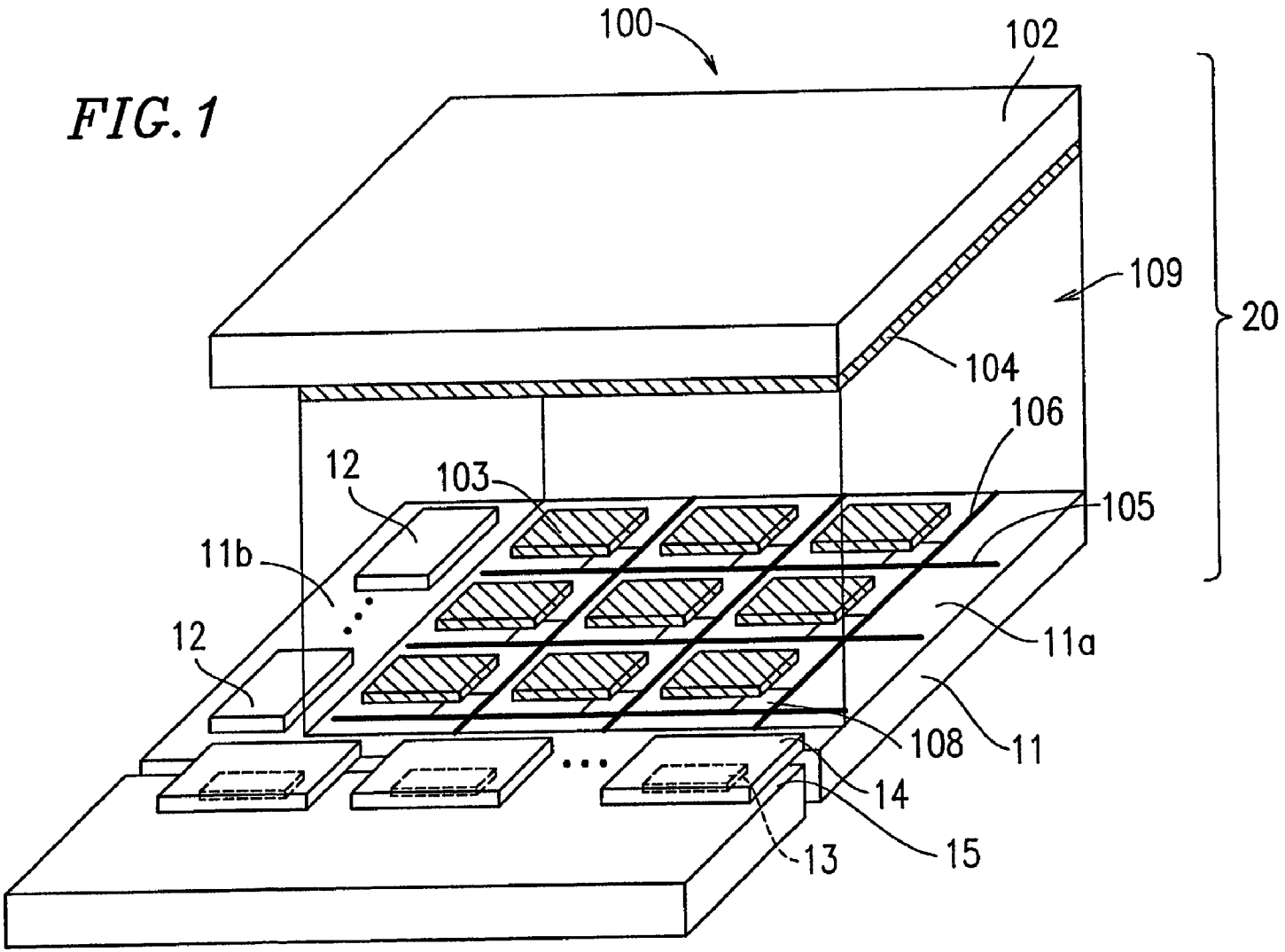
FIG. 1 is a schematic exploded isometric view of a liquid crystal display device according to one example of the present invention.

FIG. 1 is a schematic exploded isometric view of a liquid crystal display device 100 according to one example of the present invention. The liquid crystal display device 100 is of an active matrix TFT (thin film transistor) array type, which includes TFTs as switching elements. This type of liquid crystal display device is advantageous for providing high quality display.

The liquid crystal display device 100 includes a display panel 20. The display panel 20 includes a control glass substrate 11, a counter glass substrate 102, and a liquid crystal layer 109 interposed between the control glass substrate 11 and the counter glass substrate 102.

The control glass substrate 11 is rectangular and includes a rectangular display section 11*a* and a rectangular non-display section 11*b* along one side of the display section 11*a*.

A printed circuit board 15 for column electrodes is provided along one side of the control glass substrate 11. The one side of the control glass substrate 11 along which the printed circuit board 15 is provided is adjacent to the side of the display section 11 *a* along which the non-display section 11*b* is provided. There is a gap between the control glass substrate 11 and the printed circuit board 15.

The counter glass substrate 102 has a common electrode 104 provided entirely on a surface thereof, the surface being closer to the liquid crystal layer 109 than the other surface.

Figure 2:
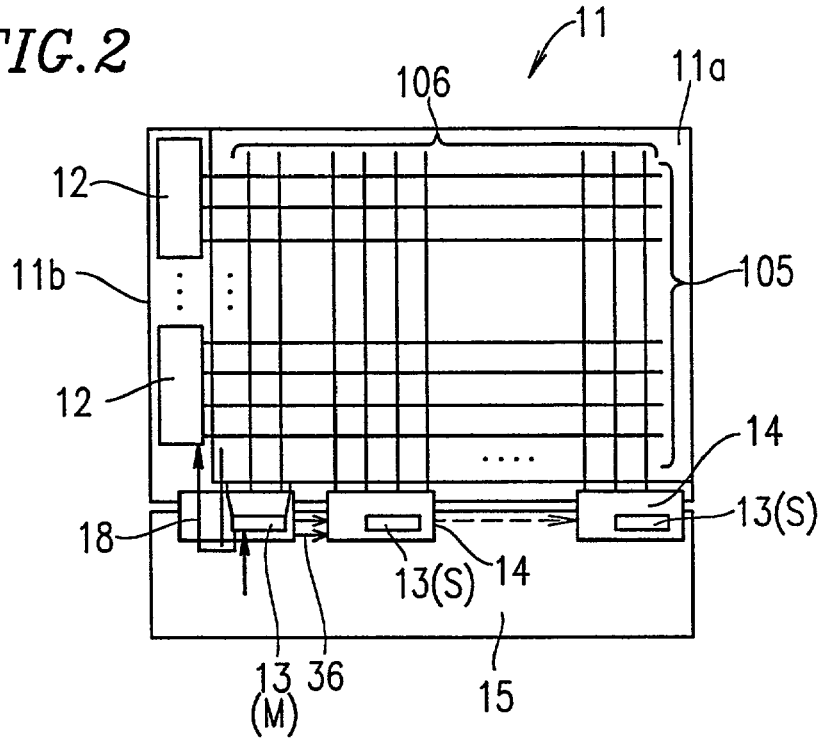
FIG. 2 is a schematic partial plan view of the liquid crystal display device shown in FIG. 1.

FIG. 2 is a schematic plan view of the control glass substrate 11 and the printed circuit board 15.

With reference to FIGS. 1 and 2, the display section 11*a* has a plurality of gate electrodes 105, a plurality of source electrodes 106, a plurality of TFTs 108, and a plurality of pixel electrodes 103 provided thereon. The plurality of gate electrodes 105 are parallel to each other, and the plurality of source electrodes 106 are parallel to each other. The plurality of gate electrodes 105 and the plurality of source electrodes 106 are substantially perpendicular to each other.

On the non-display section 11*b*, a plurality of row electrode driving circuits (gate driver ICs) 12 each for driving the plurality of gate electrodes 105 are arranged in a line.

A plurality of TCPs (Tape Carrier Packages) 14 are provided to straddle the gap between the printed circuit board 15 and the control glass substrate 11. The plurality of TCPs are arranged in a line. The plurality of TCPs respectively mount a plurality of column electrode driving circuits (source driver ICs) 13 each for driving a plurality of source electrodes 106.

The liquid crystal layer 109 includes a liquid crystal material, which is controlled by the plurality of pixel electrodes 103 provided on the control glass substrate 11 and a common electrode 104 provided on the counter glass substrate 102. The plurality of pixel electrodes 103 are each connected to a corresponding source electrode 106 via a corresponding TFT (switching element) 108, and a gate of each TFT 108 is connected to a corresponding gate electrode 105.

The liquid crystal layer 109 (FIG. 1) is provided in an area corresponding to the display section 11*a* of the control glass substrate 11. The pixel electrodes 103 (FIG. 1). are used for displaying each of the RGB colors in a 64 gray scale based on 6-bit digital data of each of the R (red), G (green) and B (blue) colors.

Each of the plurality of row electrodes 105 is supplied with a scanning signal for selecting the row electrode 105, and each of the plurality of column electrodes 106 is supplied with a display data signal for realizing gray scale display in accordance with the display data signal.

Figure 3A:
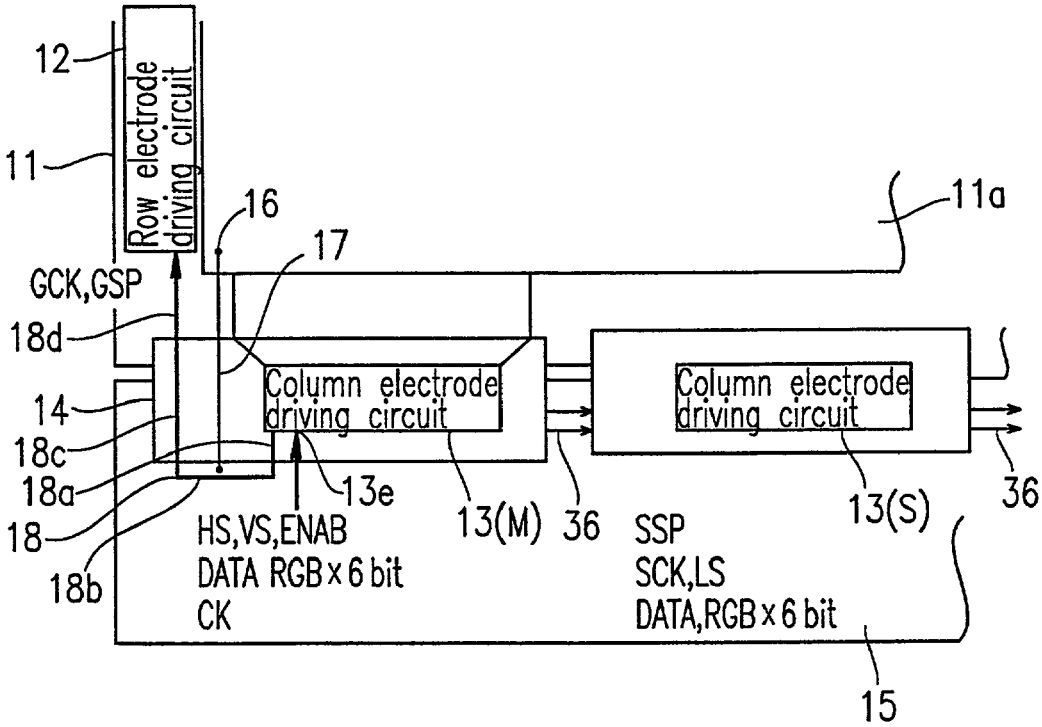
FIG. 3A is a schematic enlarged partial plan view of the liquid crystal display device shown in FIG. 1.

FIG. 3A is an enlarged partial view of FIG. 2. With reference to FIGS. 2 and 3A, the row electrode driving circuits 13 are connected in series by a line 36.

In this example, the row electrode driving circuits 12 are mounted on the control glass substrate 11. Alternatively, the row electrode driving circuits 12 can be respectively mounted in TCPs and provided on a printed circuit board, like the column electrode driving circuits 13.

Figure 4A:
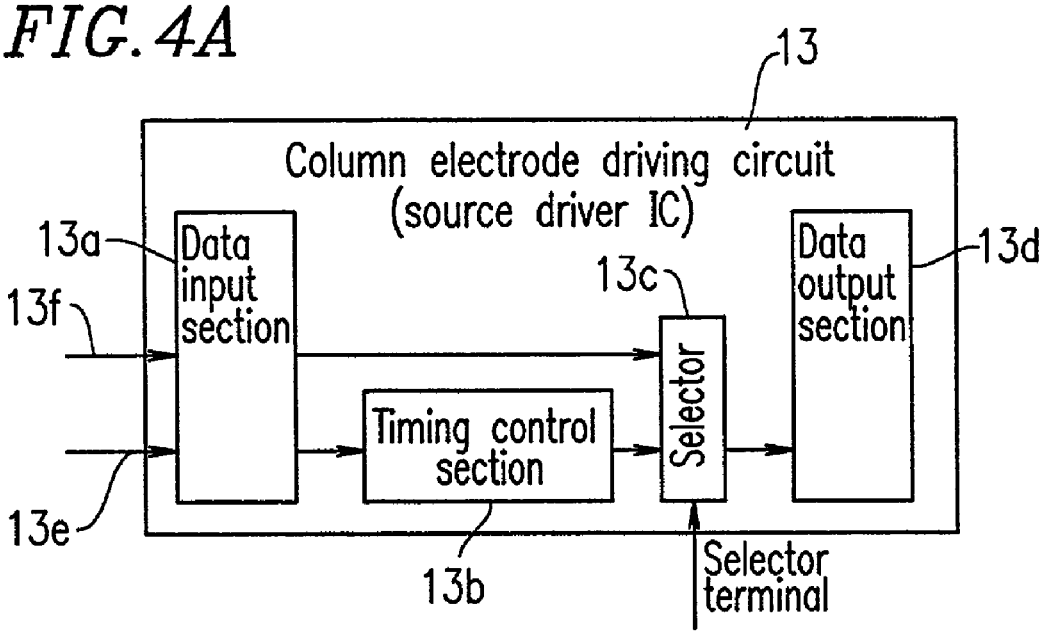
FIG. 4A is a block diagram illustrating an internal structure of a column electrode driving circuit usable in the liquid crystal display device shown in FIG. 1.

FIG. 4A is a block diagram illustrating an internal structure of one of the plurality of column electrode driving circuits 13. The other column electrode driving circuits 13 can have a similar structure.

As shown in FIG. 4A, the column electrode driving circuit 13 includes a data input section 13*a* for receiving a control data signal. The column electrode driving circuit 13 also includes a timing control section 13*b* for generating a column electrode driving timing signal and a row electrode driving timing signal based on the control data signal which is input to the data input section 13*a*. An output from the data input section 13*a* and an output from the timing control section 13*b* are supplied to a data output section 13*d* via a selector 13*c* .

The data input section 13*a* includes an external data input port 13*e* for receiving the control data signal from an external device, and a transferred data input port 13*f* for receiving the control data signal which is output from the previous column electrode driving circuit 13 when the plurality of column electrode driving circuits 13 are connected. The control data signal is a display data signal for each of the RGB colors, a clock signal CK, a horizontal synchronous signal HS, a vertical synchronous signal VS, or an enable signal ENAB.

Either one of the external data input port 13*e* and the transferred data input port 13*f* is selected to be used.

The timing control section 13*b* is switchable to an operation state in which a column electrode driving timing signal and/or a row electrode driving timing signal are generated or to a non-operation state in which neither a column electrode driving timing signal nor a row electrode driving timing signal is generated. When a control data signal is input to the external data input port 13*e* of the data input section 13*a*, the timing control section 13*b* is placed into the operation state. When a control data signal is input to the transferred data input port 13*f* of the data input section 13*a*, the timing control section 13*b* is placed into the non-operation state.

Among the plurality of column electrode driving circuits 13 having such a structure, one column electrode driving circuit 13 which is closest to the row electrode driving circuits 12 will be referred to as a "master column electrode driving circuit 13M". The master column electrode driving circuit 13M receives a control data signal from a device external to the liquid crystal display device 100 or the column electrode driving circuits 13, and the timing control section 13*b* is placed into the operation state.

The column electrode driving circuits 13 other than the master column electrode driving circuit 13M will be each referred to as a "slave column electrode driving circuit 13S". In each of the slave column electrode driving circuits 13S, the transferred data input port 13*f* is selected. Accordingly, the timing control section 13*b* of each of the slave column electrode driving circuits 13S is placed into the non-operation state. The slave column electrode driving circuit 13S connected to the master electrode driving circuit 13M receives, at the transferred data input port 13*f*, the control data signal which is output from the master electrode driving circuit 13M. The other slave column electrode driving circuits 13S each receive, at the transferred data input port 13*f*, the control data signal which is output from the previous slave electrode driving circuit 13S.

In the master column electrode driving circuit 13M, the control data signal which is input to the data input section 13*a* through the external data input port 13*e* is supplied to the timing control section 13*b*. A column electrode driving timing signal and a row electrode driving timing signal generated by the timing control section 13*b* and the data signal are supplied to the selector 13*c*. The selector 13*c* sends the column electrode driving timing signal, the row electrode driving timing signal, and the data signal to the data output section 13*d*.

The data output section 13*d* outputs the control data signal (including a timing signal SCK, SSP, LS, DATA signal, and RGB×6 bits) to the slave column electrode driving circuit 13S connected thereto by the line 36 in synchronization with the column electrode driving timing signal and the row electrode driving timing signal. The data output section 13*d* also outputs the row electrode driving timing signal generated by the timing control section 13*b* to the row electrode driving circuit 12 which is closest to the master column electrode driving circuit 13M as a scanning signal such as, for example, a gate start pulse (GSP) or a gate clock (GCK).

Based on the data control signal, each of the column electrodes 106 connected to the master column electrode driving circuit 13M is controlled.

In each of the slave column electrode driving circuits 13S, the control data signal which is output from the previous column electrode driving circuit 13 is input to the data input section 13*a* through the transferred data input port 13*f*. The control data signal is supplied to the selector 13*a*. The timing control section 13*b* is in the non-operation state. Thus, the selector 13*c* outputs the control data signal supplied from the data input section 13*a* to the data output section 13*d* without any change. The data output section 13*d* transfers the control data signal to the slave column electrode driving circuit 13S directly connected thereto via the line 36.

Thus, each of the slave column electrode driving circuits 13S transfers a control data signal from the master column electrode driving circuit 13N or the previous slave column electrode driving circuit 13S to the subsequent column electrode driving circuit 13S sequentially in a cascading manner.

Each of the column electrodes 106 connected to each slave column electrode driving circuit 13S is controlled based on the control data signal.

Figure 4B:
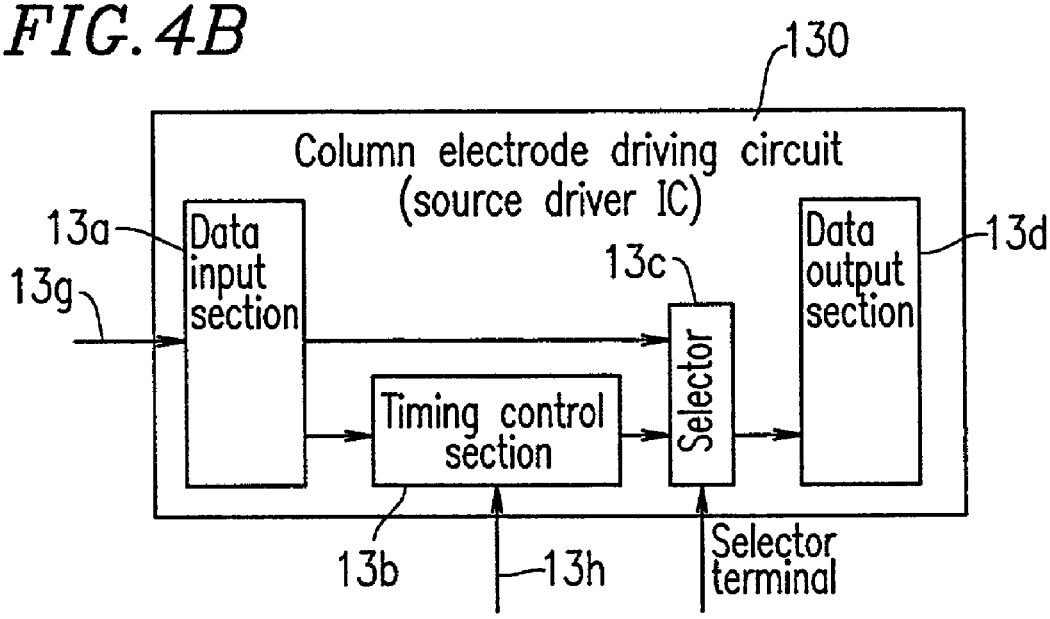
FIG. 4B is a block diagram illustrating an internal structure of another column electrode driving circuit usable in the liquid crystal display device shown in FIG. 1.
Figure 5:
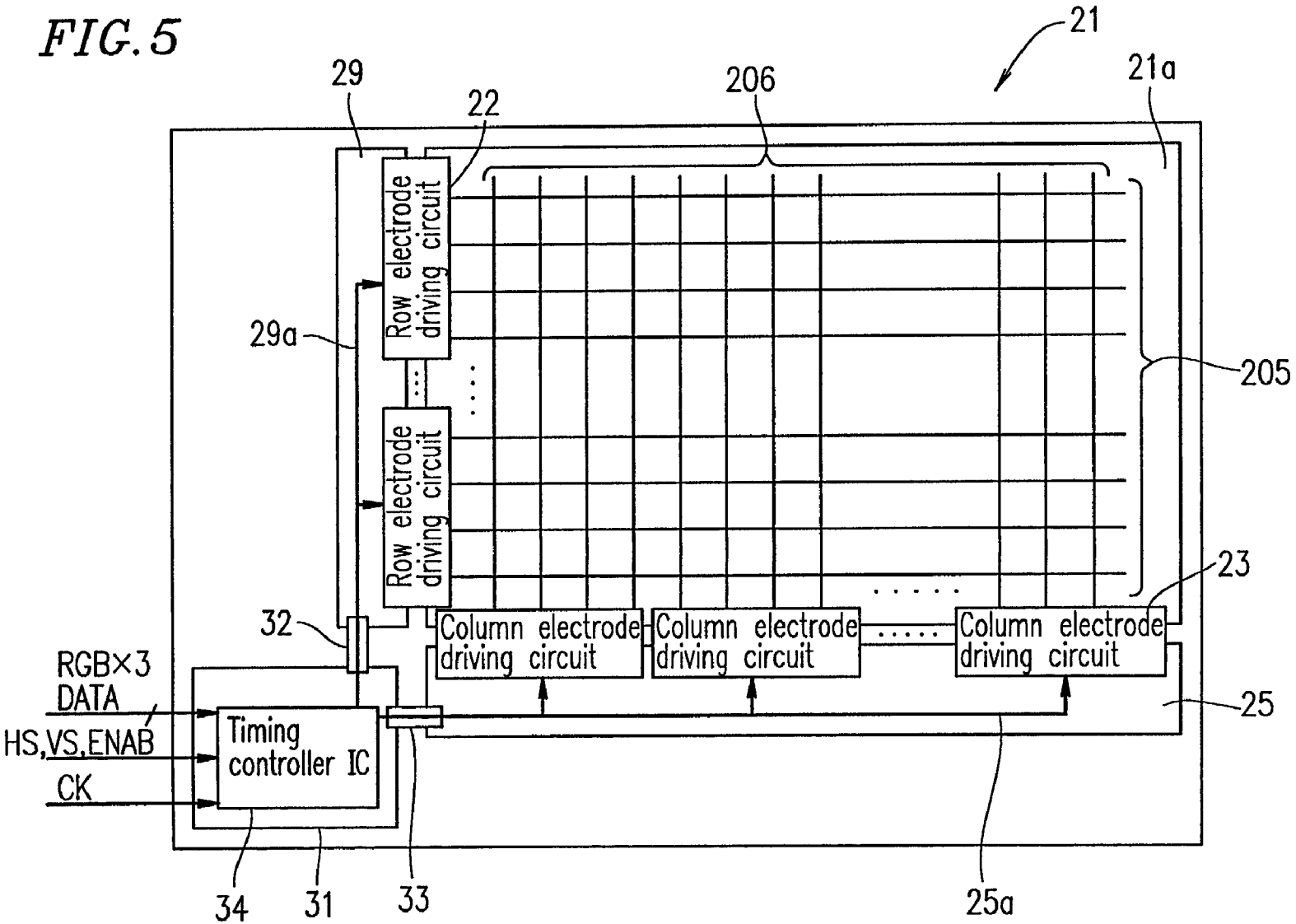
FIG. 5 is a plan view illustrating a schematic structure of a conventional liquid crystal display device.
Figure 6:
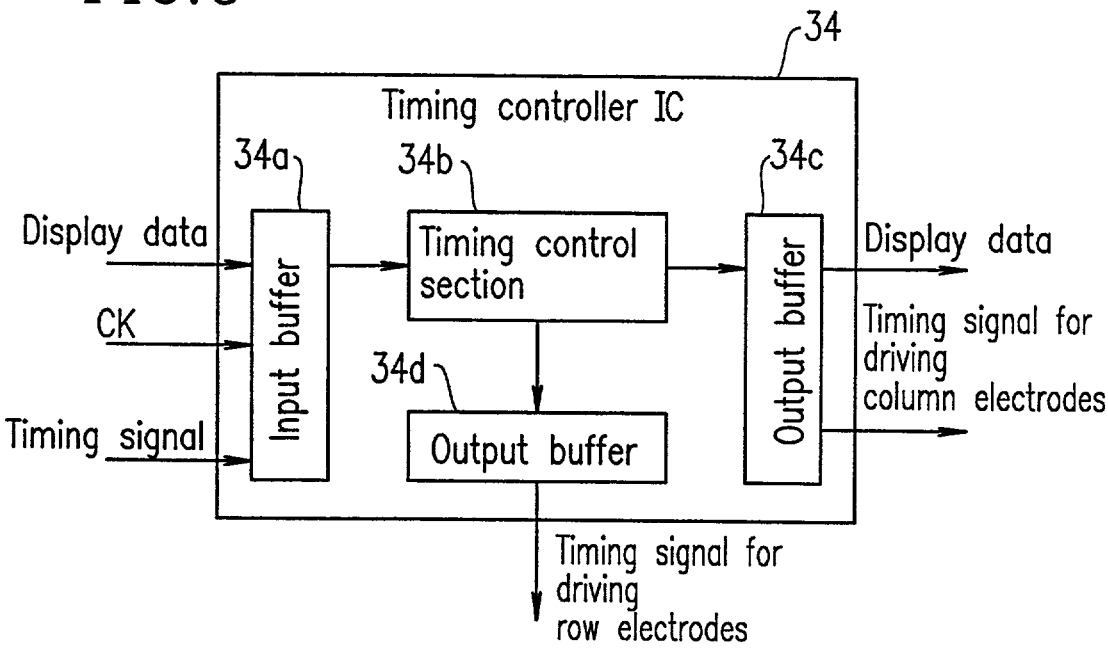
FIG. 6 is a block diagram illustrating an internal structure of a timing controller IC usable in the conventional liquid crystal display device.
Figure 7:
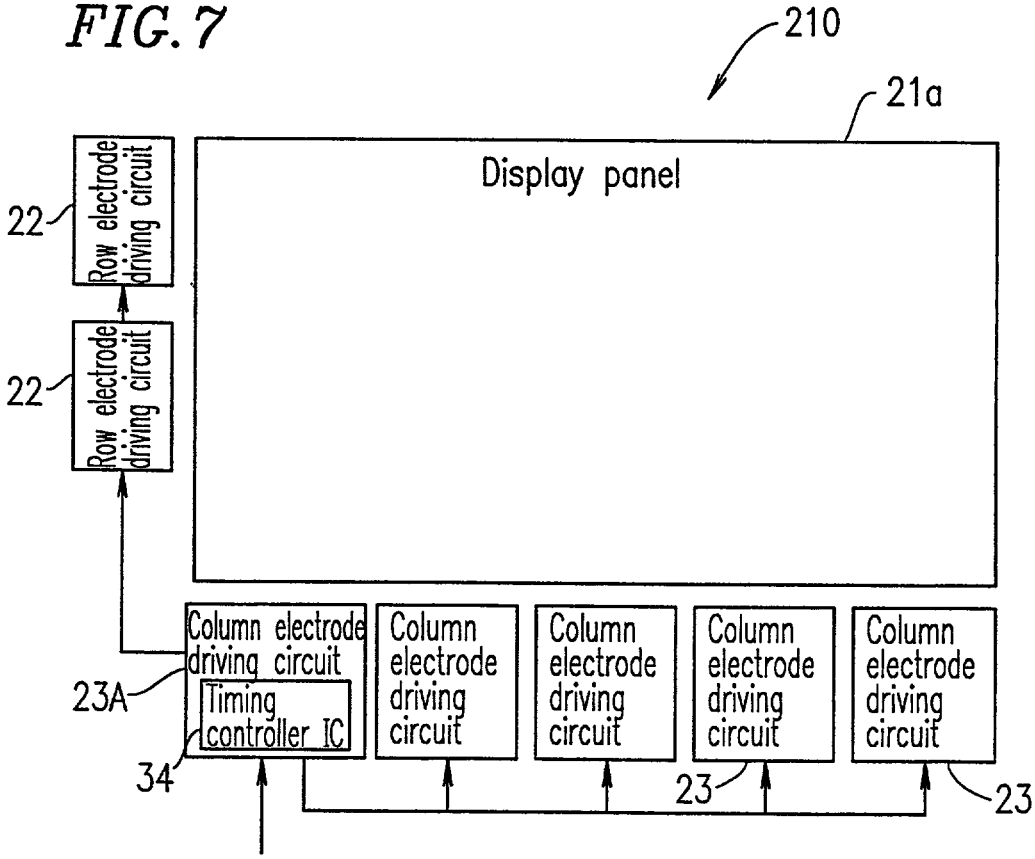
FIG. 7 is a schematic plan view of another conventional liquid crystal display device.

FIG. 4B is a block diagram illustrating another internal structure of each of a plurality of column electrode driving circuits 130.

As shown in FIG. 4B, in the column electrode driving circuit 130, a data input section 13*a* includes one data input port 13*g*. Either an external control data signal from an external device or a transferred data signal which is output from the previous column electrode driving circuit 130 is selectively input to the data input port 13*g*. The timing control section 13*b* is switchable to-an operation state or to a non-operation state by the external control data signal. Alternatively, the timing control section 13*b* is switchable by an external control signal supplied to a control terminal 13*h* included in the timing control section 13*b*.

Among the plurality of column electrode driving circuit 130 having such a structure, one column electrode driving circuit 130 which is closest to the row electrode driving circuits 12 will be referred to as a "master column electrode driving circuit 130M". The other column electrode driving circuits 130 will be each referred to as a "slave column electrode driving circuit 130S". The reference numerals 130M and 130S are not indicated in the figures but will be used for the sake of clarity.

In the master column electrode driving circuit 130M, an external control data signal is input to the data input port 13*g*, and the timing control section 13*b* is placed into the operation state by the external control signal which is input from the control terminal 13*h*. At this point, the selector 13*c* outputs the control data signal input from the data input section 13*a* to the data output section 13*d* in synchronization with the column electrode driving timing signal and the row electrode driving timing signal generated by the timing control section 13*b*. The selector 13*c* also outputs the column electrode driving timing signal and the row electrode driving timing signal themselves.

In each of the slave column electrode driving circuits 130S, the control data signal is input from the master column electrode driving circuit 130M or the previous slave column electrode driving circuit 130S through the data input port 13*g* as a transferred data signal. The timing control section 13*b* is placed into the non-operation state by the external control signal which is input from the control terminal 13*h*. The selector 13*c* outputs the control data signal to the data output section 13*d* without any change, and the data output section 13*d* outputs the control data signal.

The line 36 (FIG. 3A) used for transferring the control data signal in a cascading manner from the master column electrode driving circuit 13M or each slave column electrode driving circuit 13S can be provided either on the printed circuit board 15 or the control glass substrate 11.

As shown in FIG. 3A, a scanning signal which is output from the master column electrode driving circuit 13M is output to the row electrode driving circuit 12 closest to the master column electrode driving circuit 13M via a scanning signal line 18. The scanning signal line 18 is provided so as not to cross a common signal line 17 connected to the common electrode 104 provided on the counter glass substrate 102 (FIG. 1). In FIG. 3A, the common signal line 17 is shown for the purpose of comparison. The common signal line 17 is linearly provided from the printed circuit board 15 over the TCP 14 mounting the master column electrode driving circuit 13M, so that an end thereof is positioned on the control glass substrate 11. The common signal line 17 is connected to the common electrode 104 at a connection point 16 at a corner of the display section 11*a* of the control glass substrate 11.

The scanning signal line 18 includes a first portion 18*a* provided on the TCP 14 so as to be parallel to the common signal line 17, a second portion 18*b* provided on the printed circuit board 15 in connection with the first portion 18*a* so as to partially surround the common signal line 17, a third portion 18*c* provided in connection with the second portion 18*b* so as to cross the TCP 14, and a fourth portion 18*d* provided on the control glass substrate 11 of the display panel 20 (FIG. 1) in connection with the third portion 18*c*. The first portion 18*a*, the second portion 18*b*, the third portion 18*c* and the fourth portion 18*d* are thus provided so as not to cross the common signal line 17.

A scanning signal output from the master column electrode driving circuit 13M is supplied to the row electrode driving circuit 12 closest to the master column electrode driving circuit 13M sequentially through the first, second, third and fourth portions 18*a*, 18*b*, 18*c* and 18*d* of the scanning signal line 18. The scanning signal is then transferred to the other row electrode driving circuits 12 in a cascading manner.

In this example, no gate substrate is provided. Alternatively, a gate substrate can be provided so that the row electrode driving circuits 12 are provided on the gate substrate. In such a case, each of the row electrode driving circuits 12 acts in a manner similar to the manner described above.

In the liquid crystal display device 100 (FIG. 1) having such a structure, each of the column electrodes 106 connected to the master column electrode driving circuit 13M is controlled based on the control data signal for each of the RGB colors, the clock signal CK, the horizontal synchronous signal HS, the vertical synchronous signal VS, the enable signal ENAB and the like which are input to the master column electrode driving circuit 13M.

A control data signal, which is input to the master column electrode driving circuit 13M, is transferred to the slave column electrode driving circuit 13S directly connected thereto in synchronization with a column electrode driving timing signal generated by the timing control section 13*b* of the master column electrode driving circuit 13M. Each of the column electrodes 106 connected to the slave column electrode driving circuit 13S is controlled by the transferred control data signal. The control data signal, which is input to the above-mentioned slave column electrode driving circuit 13S, is transferred to the subsequent slave column electrode driving circuit 13S in synchronization with the timing at which the next control data signal is input.

This operation is repeated. Thus, a control data signal is sequentially transferred to the slave column electrode driving circuits 13S in a cascading manner. Each of the column electrodes 106 connected to each of the slave column electrode driving circuits 13S is controlled based on the control data signal transferred to the respective slave column electrode driving circuit 13S.

The master column electrode driving circuit 13M outputs a row electrode driving timing signal generated by the timing control section 13*b* thereof to the row electrode driving circuit 12 closest thereto via the scanning signal line 18 as a scanning signal such as, for example, a GSP or a GCK. The row electrode driving circuit 12 controls each of the column electrodes 105 connected thereto based on the received scanning signal. The scanning signal input to the row electrode driving circuit 12 is sequentially transferred to the subsequent row electrode driving circuits 12 in synchronization with the timing at which the next scanning signal is input.

This operation is repeated. Thus, a scanning signal is sequentially transferred to the row electrode driving circuits 12 in a cascading manner. Each of the row electrodes 105 connected to each of the row electrode driving circuits 12 is driven based on the scanning signal transferred to the respective row electrode driving circuit 12.

As described above, according to the present invention, the master column electrode driving circuit 13M includes the timing control section 13*b* for generating a column electrode driving timing signal and a row electrode driving timing signal. Such a structure can eliminate the timing controller IC for generating the column electrode driving timing signal and the row electrode driving timing signal, a substrate for mounting the timing controller IC and the like, and therefore an FPC for electrically connecting the timing controller IC to the printed circuit board for the column electrodes or the like. As a result, the liquid crystal display device 100 has a smaller overall size and can be assembled and produced more easily.

The control data signal for each of the slave column electrode driving circuits 13S is transferred from the master column electrode driving circuit 13M or the previous column electrode driving circuit 13S. Therefore, the data output section 13*d* in each of the column electrode driving circuits 13S needs to have only the capability of transferring the control data signal via the line 36, which is relatively short. Thus, each of the column electrode driving circuits 13 can be more compact.

The scanning signal for each of the row electrode driving circuits 12 is transferred from the previous row electrode driving circuit 12. Therefore, the line for transferring the scanning signal can be shorter, and thus each of the row electrode driving circuits 12 can be more compact.

In the above example, the master column electrode driving circuit 13M and the slave column electrode driving circuits 13S have a similar structure, so that the function of the master circuit and the slave circuit can be changed by a manipulation from an external device. Therefore, the column electrode driving circuits 13 can be mounted on the printed circuit board 15 without considering which is the master circuit and which are the slave circuits. Thus, each of the column electrode driving circuit 13 can be mounted efficiently using a conventional mounting device of column electrode driving circuits.

The column electrode driving circuits 13 are each provided on the printed circuit board 15 in the state of being mounted in the respective TCP 14. Due to such a structure, the scanning signal line 18 for supplying a scanning signal from the master column electrode driving circuit 13M to the row electrode driving circuit 12 can be easily formed on the TPC 14 and the printed circuit board 15 so as not to cross the common signal line 17. In a structure where the column electrode driving circuits are formed on a glass substrate by COG (chip on glass), the freedom is limited in providing a scanning signal line and it is difficult to connect the line on the glass substrate and the column electrode driving circuits.

In the above example, the liquid crystal display device 100 is used as an example of a display device. The present invention is applicable to a wide variety of display devices.

Figure 3B:
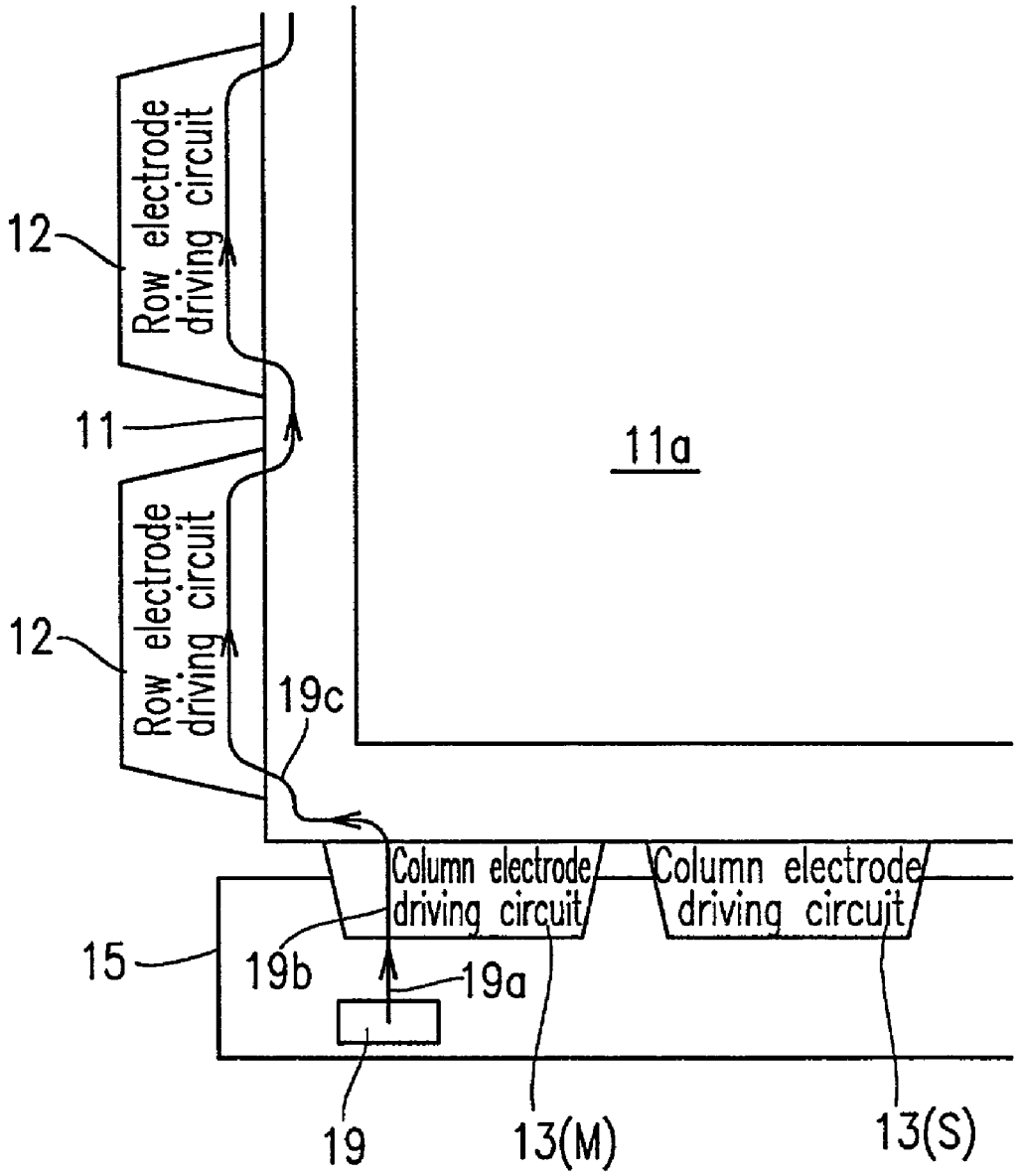
FIG. 3B is a schematic enlarged partial plan view of another liquid crystal display device according to the present invention.

FIG. 3B is an enlarged plan view schematically illustrating a part of a liquid crystal display device according to another example of the present invention.

In the liquid crystal display device shown in FIG. 3B, a timing signal for controlling each of the row electrode driving circuits 12 is generated by an element other than the column electrode driving circuits 13 (for example, a timing signal generation circuit 19 formed of a dedicated IC). A scanning signal line includes a second portion 19*a* provided on the printed circuit board 15, a third portion 19*b* provided on one of the plurality of column electrode driving circuits 13, and a fourth portion 19*c* provided on the control glass substrate 11 of the display panel 20. The timing signal generated by the timing signal generation circuit 19 can be supplied to one of the plurality of row electrode driving circuits 12 sequentially through the second portion 19*a*, the third portion 19*b* and the fourth portion 19*c*.

In such a structure, a timing signal can be supplied to the row electrode driving circuits 12 without using a printed circuit board for row electrode driving circuits. As a result, a simpler and more compact structure, lower production cost and high productivity are provided.

The timing signal generation circuit 19 is not necessarily required to be in the column electrode driving circuits 13, and can be provided on the printed circuit board 15 or outside the printed circuit board 15. For example, an external dedicated LSI can have a timing signal generation function as a part of a logic circuit. In such a case, the restriction on the space for the timing signal generation circuit is reduced so as to improve the geographical freedom.

A plurality of column electrode driving circuits according to the present invention decreases the size of the display device and allows the display device to be produced more easily.

A display device according to the present invention is sufficiently compact and can be produced easily and at low cost despite a plurality of column electrode driving circuits and a plurality of row electrode driving circuits included therein.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A plurality of column electrode driving circuits in a matrix type display device including a plurality of row electrode driving circuits connected in series each for driving a plurality of row electrodes and the plurality of column electrode driving circuits connected in series each for driving a plurality of column electrodes, each of the plurality of column electrode driving circuits comprising;

a data input section for receiving a control data signal for the plurality of column electrodes;

a timing control section for generating a timing control signal for controlling at least one of the row electrode driving circuit and the column electrode driving circuit;

a selection section for selecting one of a signal in synchronization with the timing signal generated by the timing control section and the control data signal input to the data input section, based on the control data signal input to the data input section; and a data output section for outputting one of the signal in synchronization with the timing signal and the control data signal which is selected by the selection section, wherein the data input section of a second column electrode driving circuit of the plurality of column electrode driving circuits is connected to the data output section of a first column electrode driving circuit of the plurality of column electrode driving circuits, and the data output section of the second column electrode driving circuit is connected to the data input section of a third column electrode driving circuit of the plurality of column electrode driving circuits.

2. A plurality of column electrode driving circuits according to claim 1, wherein:

the data input section of the second column electrode driving circuit includes an external data input port for receiving an external control data signal and a transferred data input port for receiving a control data signal from the first column electrode driving circuit, the external data input port and the transferred data input port being switchable, and the timing control section of the second column electrode driving circuit is switchable to an operation state or a non-operation state in accordance with the switching between the external data input port and the transferred data input port.

3. A plurality of column electrode driving circuits according to claim 1, wherein:

the data input section of the second column electrode driving circuit receives one of the external data signal and the control data signal from the first column electrode driving circuit which is selectively input thereto, and the timing control section of the second column electrode driving circuit is switchable to an operation state or a non-operation state by the external control data signal.

4. A display device, comprising:

a display panel;

a plurality of column electrode driving circuits according to claim 1 provided on the display panel; and a plurality of row electrode driving circuits provided on the display panel, wherein;

the plurality of column electrode driving circuits are connected in series along a first side of the display panel, so that a scanning signal from the first column electrode driving circuit, among the plurality of column electrode driving circuits, which is closest to the plurality of row electrode driving circuits, is transferred in a cascading manner in the plurality of column electrode driving circuits, the plurality of row electrode driving circuits are connected in series along a second side of the display panel adjacent to the first side, so that the scanning signal from the first column electrode driving circuit is transferred in a cascading manner in the plurality of row electrode driving circuits, an external control data signal is input to the data input section of the first column electrode driving circuit and is output in synchronization with a timing signal generated by the timing control section of the first column electrode driving circuit, the external control data signal which is output from the first column electrode driving circuit is transferred sequentially in the rest of the plurality of column electrode driving circuits in a cascading manner, and the timing signal is transferred sequentially in the plurality of row electrode driving circuits in a cascading manner as the scanning signal.

5. A matrix type display device, comprising:

a display panel;

a plurality of column electrode driving circuits connected in series and provided along a first side of the display panel; and a plurality of row electrode driving circuits connected in series and provided along a second side of the display panel, the second side being adjacent to the first side, wherein;

a control data signal for driving the display panel is input to a first column electrode driving circuit, among the plurality of column electrode driving circuits, which is closest to the plurality of row electrode driving circuits, a timing signal for controlling an operation timing of the plurality of column electrode driving circuits and the plurality of row electrode driving circuits is generated in the first column electrode driving circuit, and the generated timing signal and a data signal are output to a second column electrode driving circuit, among the plurality of column electrode driving circuits, which is directly connected to the first column electrode driving circuit, the output data signal is transferred to a third column electrode driving circuit, among the plurality of column electrode driving circuits, which is directly connected to the second column electrode driving circuit, and the generated timing signal is transferred in a cascading manner to the plurality of row electrode driving circuits as a scanning signal.

6. A matrix type display device, comprising:

a display panel;

a plurality of column electrode driving circuits connected in series on a printed circuit board provided along a first side of the display panel; and a plurality of row electrode driving circuits connected in series and provided along a second side of the display panel, the second side being adjacent to the first side, wherein;

each of the plurality of column electrode driving circuits is mounted in a tape carrier package;

a first column electrode driving circuit, among the plurality of column electrode driving circuits, which is closest to the plurality of row electrode driving circuits, generates a timing signal for controlling an operation timing of the plurality of column electrode driving circuits and the plurality of row electrode driving circuits, generates a timing signal for controlling an operation timing of the plurality of column electrode driving circuits and the plurality of row electrode driving circuits, and outputs the generated timing signal to a first row electrode driving circuit, among the plurality of row electrode driving circuits, which is closest to the first column electrode driving circuit as a scanning signal, a timing signal which is output from the first column electrode driving circuit is supplied to the first row electrode driving circuit sequentially through a first line portion provided on the tape carrier package mounting the first column electrode driving circuit, a second line portion provided on the printed circuit board, a third line portion provided on the tape courier package mounting the first column electrode driving circuit, and a fourth line portion provided on the display panel.

7. A matrix type display device, comprising:

a display panel a plurality of column electrode driving circuits connected in series on a printed circuit board provided along a first side of the display panel; and a plurality of row electrode driving circuits connected in series and provided along a second side of the display panel, the second side being adjacent to the first side, wherein a timing signal for controlling the plurality of row electrode driving circuits is supplied to one of the plurality of row electrode driving circuits sequentially through a second line portion provided on the printed circuit board, a third line portion provided on one of the plurality of column electrode driving circuits, and a fourth line portion provided on the display panel.

8. A matrix type display device, comprising a display panel;

a plurality of column electrode driving circuits connected in series on a circuit board provided along a first side of the display panel; and a plurality of row electrode driving circuits connected in series and provided along a second side of the display panel, the second side being adjacent to the first side wherein;

a first column electrode driving circuit, among the plurality of column electrode driving circuits, which is closest to the plurality of row electrode driving circuits, generates a timing signal for controlling an operation timing of the plurality of column electrode driving circuits and the plurality of row electrode driving circuits, and outputs the generated timing signal to a first row electrode driving circuit, among the plurality of row electrode driving circuits, which is closest to the first column electrode driving circuit as a scanning signal, a timing signal generation circuit is provided to use for signals being different from a timing signal which is output from the first column electrode driving circuit; and the timing signal which is output from the first column electrode driving circuit is supplied to the first row electrode driving circuit sequentially through the circuit board as not to be cross with the timing signal generation circuit.

* * * * *